United States Patent [19]

Varlonga

[11] 4,344,254

[45] Aug. 17, 1982

[54] THERMALLY INSULATED ALUMINUM DOOR OR WINDOW FRAME

[75] Inventor: Giovanni Varlonga, Milan, Italy

[73] Assignee: Feal S.p.A., Milan, Italy

[21] Appl. No.: 133,058

[22] Filed: Mar. 24, 1980

[30] Foreign Application Priority Data

May 2, 1979 [IT] Italy ..... 21463/79[U]

[51] Int. Cl.[3] ..... E05D 7/00; E06B 1/22

[52] U.S. Cl. ..... 49/401; 49/504; 49/DIG. 1; 52/403

[58] Field of Search ..... 49/401, 400, DIG. 1, 49/504; 52/397, 730, 403

[56] References Cited

U.S. PATENT DOCUMENTS

| | | | |
|---|---|---|---|
| 2,497,957 | 2/1950 | Pelley | 52/397 X |
| 3,861,085 | 1/1975 | Jacob | 49/DIG. 1 X |
| 4,084,361 | 4/1978 | Aspaas | 49/DIG. 1 X |
| 4,115,972 | 9/1978 | Varlonga | 49/DIG. 1 X |

*Primary Examiner*—Philip C. Kannan

*Attorney, Agent, or Firm*—Guido Modiano; Albert Josif

[57] ABSTRACT

A metal door or window frame comprises mobile and fixed frameworks each formed by a sub-frame including a substantially tubular section effective to be positioned on the side thereof facing the room interior and a cover section effective to be positioned on the side thereof facing outwards, between the sub-frames and the cover sections insulating material elements being provided for defining an uninterrupted heat insulating barrier therebetween.

1 Claim, 1 Drawing Figure

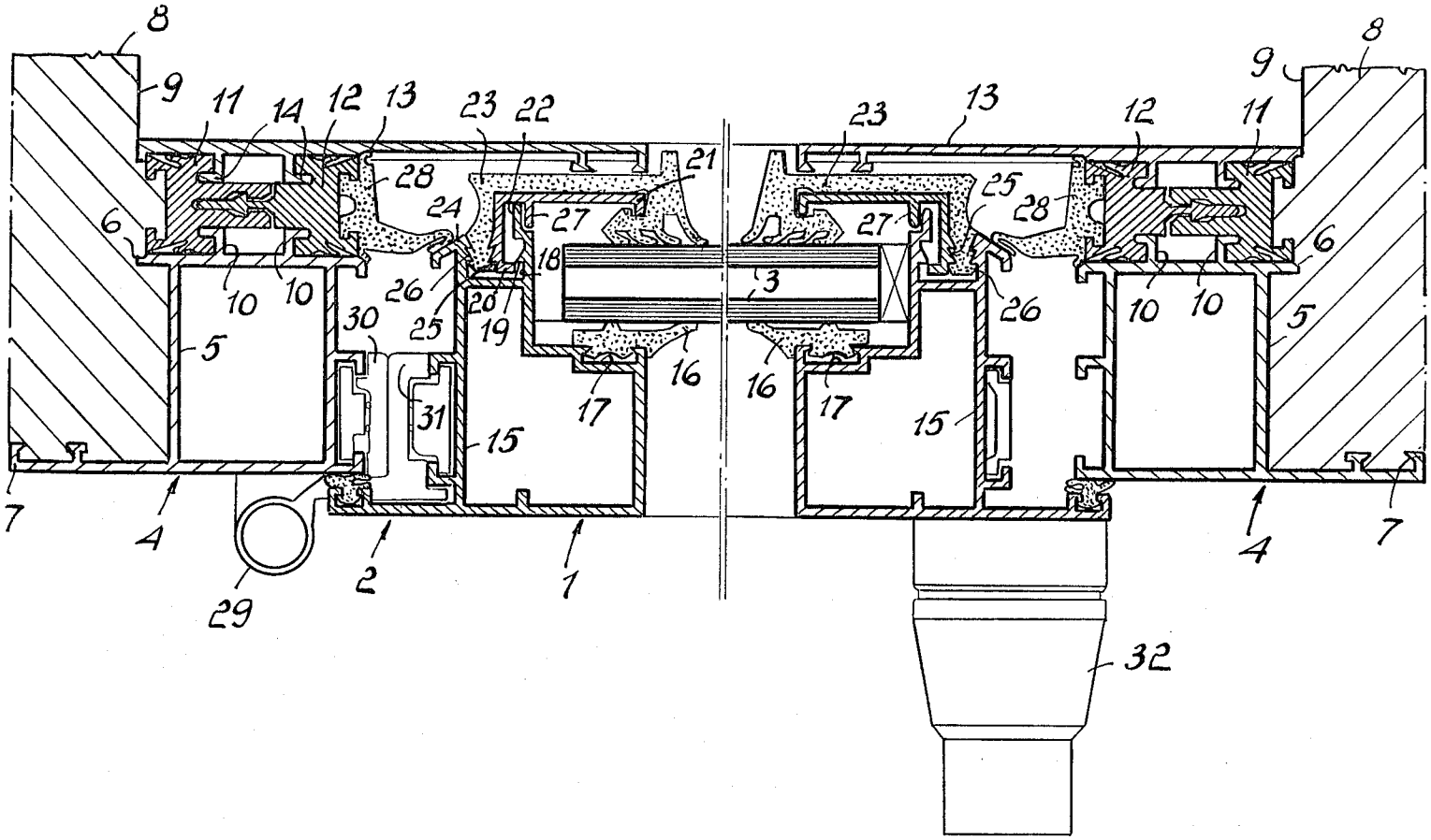
8
9
11
12
13
23
22
14
6
5
10
28
25
26
27
3
21
18
19
20
24
30
31
29
32
15
16
17
1
2
4
7

THERMALLY INSULATED ALUMINUM DOOR OR WINDOW FRAME

BACKGROUND OF THE INVENTION

This invention relates to a thermally insulated aluminum door or window frame.

One of the problems which needs to be solved with metal door or window frames is the problem of providing good heat insulation in view of the fact that metals are among the best heat conductors. In this respect, it has already been proposed to create a so-called heat barrier in the frame, i.e. to form a barrier of heat insulating material between the outer parts of the frame which are generally exposed to the atmospheric agents and its inner parts which face the room in which the frame is installed.

SUMMARY OF THE INVENTION

The object of the present invention is an improved metal door or window frame which, when assembled in position, provides a heat barrier practically without interruption, while at the same time allowing the frame components to be substantially simplified.

A further object of the invention is that said door or window frame can be constructed at a lower cost than door or window frames which have already been proposed, and can be more easily and rapidly assembled in position.

These and further objects which will be more apparent hereinafter are attained by a metal door or window frame comprising a fixed framework for its fixing to a rim contour of an opening in a wall of a room into which the door or window frame is to be mounted, a mobile framework for framing therein at least one pane of glass and the like and heat insulating gasket elements cooperating therewith, said rim contour lying in a plane of the opening, the frame having a width extension extending perpendicular to the rim contour of said opening and parallel to said plane and a depth extension extending perpendicular to said plane, wherein the fixed framework and the mobile framework are constituted by a fixed and a mobile subframes respectively, formed from a substantially tubular section arranged on that side of the frameworks facing the room interior, and a fixed and a mobile cover sections respectively arranged on that side of the frameworks facing outwards, said gasket elements of heat insulating material being arranged between the subframes and the cover sections for providing an uninterrupted heat insulating barrier therebetween, at least some of said gasket elements having connection formations cooperating in the connection between the cover sections and the subframes, wherein said fixed cover section for the fixed subframe is substantially flat and extends parallel to said plane and substantially over the entire width extension of said frame and has profiled lugs in engagement with said connection formations of said gasket elements and arranged offset at a distance from said mobile cover section to provide a first interspace therebetween, when said mobile framework is in the closed position, and wherein said mobile cover section has a flange portion extending perpendicular to said width extension and a web portion extending parallel to said width extension when said mobile framework is in closed position and parallel to said panes, said web portion having an end zone overlapping an edge portion of said panes at a distance therefrom to provide a second interspace therebetween, said mobile subframe has on the side facing said mobile cover section a channel-shaped formation formed of a pair of spaced apart ribs extending from said mobile subframe side perpendicular to said web portion and a bottom portion between said ribs, a first of said ribs nearest to said panes having an abuttment edge in engagement with said web portion, said flange portion extending into the channel space defined by said channel formation and at a distance from a second of said ribs to provide a third interspace between said second rib and said flange portion, said flange portion having a nose formation on an end thereof facing said bottom portion and said first rib having a shoulder formation near said bottom portion adapted to engage said nose formation thereby said abuttment edge and said shoulder formation defining two spaced apart points of engagement between said mobile cover section and said mobile subframe, a channel shaped gasket element having a gasket web portion extending over said web portion of said mobile cover section and spaced apart gasket flange portions, one of said gasket flange portion being at a distance from said panes and inserted into said third interspace, the other of said gasket flange portions having an inwardly bent extension towards said channel defined space thereby to embrace said end zone of said web portion and be inserted into said second interspace in engagement with said edge portion of said panes, said gasket inwardly bent extension and said gasket flange portion having surface formation for a forcible insertion in said second and said third interspace thereby to firmly hold in position said mobile cover section in cooperation with said spaced apart points of engagement of said mobile cover section and to firmly hold in position said frames.

BRIEF DESCRIPTION OF THE DRAWING

The invention is described hereinafter in greater detail with reference to the accompanying drawing, of which the single FIGURE is a cross-section through a door or window frame according to the invention, when assembled in position.

DESCRIPTION OF A PREFERRED EMBODIMENT

The drawing shows a door or window frame indicated overall by 1, comprising a mobile framework 2 for framing two interspaced glass panes 3, or double glazing, and a fixed framework 4. This latter is formed from a tubular section 5 comprising lugs 6 and 7 for its fixing to the rim contour 8 of a door or window opening 9 into which the door or window frame 1 is mounted. The rim contour defines a plane of the opening. The width of the frame extends parallel to said plane and the depth of the frame extends perpendicular thereto. The tubular section 5 is positioned on that side facing the interior of the room. On that of its faces which faces outwards, the tubular section 5 comprises fixing lugs 10 into which are fixed by means of connection formations two elements 11 and 12 which are connected together in such a manner as to form a double insertion joint. A substantially plate-shaped cover section 13 is fixed to the joint formed by the elements 11 and 12. The connection between the double insertion joint 11, 12 and the cover section 13 is made by forcing lugs 14 on the section into respective cavities in the joint.

The mobile framework 2 is formed by a tubular section 15 which extends around the glass panes 3 and frames them. The glass panes are supported by the mobile framework 2, and that pane which faces the interior of the room rests along its peripheral edge against gasket elements 16 inserted in a respective seat 17 defined by the tubular section 15. The tubular section 15, in a like manner to the tubular section 5, is disposed on that side facing the interior of the room. On its external side, the tubular section 15 comprises a groove 18 defining a shoulder 19 against which is fixed a profiled end or nose 20 of a cover section 21 for the mobile sub-frame. The cover section 21 abuts against a projection 22 extending from the tubular section 15, and is forced into a position of engagement against the shouler 19 by a channel shaped gasket element 23 having a web portion and flange portions on the opposite ends of the web portion. For this purpose, as can be seen from the drawing, the cover section 21 of the mobile framework 2 is substantially of L-shape with a flange portion perpendicular to the panes 3 and a web portion parallel to said panes and at a distance thereform to define an interspace therebetween. The flange portion of the L being retained in its position of coupled engagement with the tubular section 15 by the wedge action exerted by a connection formation or flange formation of the gasket element 23 which is forcibly inserted between the flange portion of the L and a fin or rib 24 on the tubular section 15. Preferably, the flange portion of the section 21 and the fin 24 facing it, between which a further interspace is formed, comprise grooves which define undercut shoulders 25 and 26 to prevent the gasket 23 from escaping once it has been inserted therein. It will be noted that the fins or ribs 22 and 24 form a channel shaped formation on the tubular section 15 of the mobile subframe. It will be further noted that the free edge of the rib 22 is an abuttment edge and that such abuttment edge and the shoulder formation 18 define two spaced apart points of engagement between the mobile cover section 21 and the mobile subframe 15.

The web portion corresponding to the shank of the L of the cover section 21 is completely surrounded externally by the gasket 23, which becomes interposed between the outer glass pane 3 and the section 21, and thus provides a heat seal between these latter.

The section 21 is prevented from sagging laterally beyond certain limits by the presence of a projection 27.

As can be seen from the drawing, the cover section 13 has a length such as to cover both the extent of the tubular section 5 and the extent of the tubular section 15. However, it should be noted, and this represents an important characteristic of the invention, that between the cover section 13 and the fixed framework 4 and mobile framework 2, there is a heat insulating barrier formed by the double insertion joint 11 and 12, by a gasket 28 fixed by means of connection formations to the joint 11, 12 and projecting as far as the fin 24 of the tubular section 15, and by the gasket element 23.

The mobile framework 2 is mounted in the normal manner on the pintles 29 of hinges 30, 31, and can be opened inwards by a handle 32.

It is apparent that with a door or window frame according to the invention, perfect heat insulation is obtained between a room and the outside both by the effect of the double glazing and by the effect of the heat insulating barrier which protects the metal parts facing towards the inside of the room from contact with the outside.

By way of example, materials suitable for forming the heat insulating barrier are PVC, polyethylene and rubber (DUTRAL).

I claim:

1. A metal door or window frame comprising a fixed framework for its fixing to a rim contour of an opening in a wall of a room into which the door or window frame is to be mounted, a mobile framework for framing therein one or more panes of glass and the like and heat insulating gasket elements cooperating therewith, said rim contour lying in a plane of the opening, the frame having a width extension extending perpendicular to the rim contour of said opening and parallel to said plane and a depth extension extending perpendicular to said plane, wherein the fixed framework and the mobile framework are constituted by a fixed and a mobile subframe respectively, formed from a substantially tubular section arranged on that side of the frameworks facing the room interior, and a fixed and a mobile cover section respectively arranged on that side of the frameworks facing outwards, said gasket elements of heat insulating material being arranged between the subframes and the cover sections for providing an uninterrupted heat insulating barrier therebetween, at least some of said gasket elements having connection formations cooperating in the connection between the cover sections and the subframes, wherein said fixed cover section for the fixed subframe is substantially flat and extends parallel to said plane and substantially over the entire width extension of said frame and has profiled lugs in engagement with said connection formations of said gasket elements and arranged offset at a distance from said mobile cover section to provide a first interspace therebetween, when said mobile framework is in the closed position, and wherein said mobile cover section has a flange portion extending perpendicular to said width extension and a web portion extending parallel to said width extension when said mobile framework is in closed position and parallel to said panes, said web portion having an end zone overlapping an edge portion of said panes at a distance therefrom to provide a second interspace therebetween, said mobile subframe has on the side facing said mobile cover section a channel-shaped formation formed of a pair of spaced apart ribs extending from said mobile subframe side perpendicular to said web portion and a bottom portion between said ribs, a first of said ribs nearest to said panes having an abuttment edge in engagement with said web portion, said flange portion extending into the channel space defined by said channel formation and at a distance from a second of said ribs to provide a third interspace between said second rib and said flange portion, said flange portion having a nose formation on an end thereof facing said bottom portion and said first rib having a shoulder formation near said bottom portion adapted to engage said nose formation thereby said abuttment edge and said shoulder formation defining two spaced apart points of engagement between said mobile cover section and said mobile subframe, a channel shaped gasket element having a gasket web portion extending over said web portion of said mobile cover section and spaced apart gasket flange portions, one of said gasket flange portion being at a distance from said panes and inserted into said third interspace, the other of said gasket flange portions having an inwardly bent extension towards said channel defined space thereby to embrace said end zone of said web portion and be inserted into said second interspace in engagement with said edge portion of said panes, said gasket inwardly bent extension and said gasket flange portion having surface formation for a forcible insertion in said second and said third interspace thereby to firmly hold in position said mobile cover section in cooperation with said spaced apart points of engagement of said mobile cover section and to firmly hold in position said frames.

* * * * *